United States Patent [19]

Moorhouse

[11] 4,073,171

[45] Feb. 14, 1978

[54] LOCK STRUCTURE

[76] Inventor: John H. Moorhouse, Clear Lake, Minn. 55319

[21] Appl. No.: 612,306

[22] Filed: Sept. 11, 1975

[51] Int. Cl.[2] ..... E05B 29/02

[52] U.S. Cl. ..... 70/366; 70/421; 70/375

[58] Field of Search ..... 70/366, 365, 375, 419, 70/421, 379 R, 380

[56] References Cited

U.S. PATENT DOCUMENTS

| | | | |
|---|---|---|---|
| 1,232,792 | 7/1917 | Grimes | 70/380 |
| 1,376,256 | 4/1921 | Conte | 70/366 |
| 3,216,230 | 11/1965 | Falk | 70/421 |
| 3,863,476 | 2/1975 | Patriquin | 70/419 |

*Primary Examiner*—Robert L. Wolfe

*Attorney, Agent, or Firm*—Leo Gregory

[57] ABSTRACT

A lock device comprising a housing having a plurality of rotatable cylindrical members therein, one of said cylindrical members being integral with a latch operating member, each of said cylindrical members having one or more tumblers, said tumblers normally holding said cylindrical members in a locked non-rotatable position, said cylindrical members being interengaged with each having limited relative movement, and an operating member engaging and operating said tumblers in a given order to rotate said cylindrical members in a like order, said cylindrical members progressively joining together in rotation until all of said tumblers have been engaged and operated at which time all of said cylindrical members will be inter-engaged to rotate as a unit to move said latch operating member to an unlock position.

7 Claims, 13 Drawing Figures

LOCK STRUCTURE

BACKGROUND AND SUMMARY OF THE INVENTION

The invention herein relates to a lock structure wherein the improvement consists of a plurality of cylindrical members having inter-engagement, having limited relative movement and being joined progressively in rotation by operating means whereby all of said cylindrical members rotate as a unit to fully actuate a latch operating member.

The essential improvement herein consists in an arrangement whereby each of said cylindrical members includes one or more tumblers and said tumblers must be engaged and operated in a given order to rotate said cylindrical members in the operation of the lock. Said tumblers may vary from one another in specific detail as to their structure and as to their operation by an operating member to make the lock structure a very secure lock and to provide for a very large member of different specific arrangements for the operating member.

It is an object of the invention therefore to provide a lock device comprising a plurality of inter-related cylindrical members and operating means, whereby said cylindrical members progressively join one another in a given order for rotation until all of the cylindrical members are rotated as a unit to move a latch actuating member to an unlocking position.

It is a further object of this invention to provide a lock device comprising a plurality of cylindrical members, each of said members having mounted therein one or more tumblers, said tumblers normally securing said cylindrical members in a non-rotating locked position and an operating member arranged and constructed to engage and operate said tumblers in a given order for the rotation of said cylindrical members.

It is more specifically an object of this invention to provide a lock device comprising a housing, a plurality of interrelated cylindrical members in said housing with each of said members having limited relative movement and which progressively join one another in a given order for rotation, each of said cylindrical members having one or more tumblers normally holding said cylindrical members in a non-rotating locked position, a latch operating member carried by said housing and having integral rotation with at least one of said cylindrical members and a key member disposed in said housing arranged and constructed to engage said tumblers in a given order for a progressive rotation of said cylindrical members in a like order until all of said cylindrical members are rotated as a unit for rotation of said latch member to an unlocking position.

These and other objects and advantages of the invention will be set forth in the following description made in connection with the accompanying drawings in which like reference characters refer to similar parts throughout the several views and in which:

FIG. 1 is a view in end elevation of one end of the device herein with portions thereof shown in dotted line;

FIG. 13 is an exploded view.

DESCRIPTION OF A PREFERRED EMBODIMENT

Figure 3:
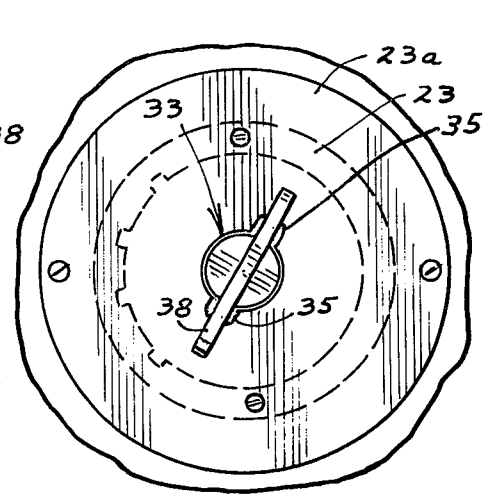
FIG. 3 is a view in end elevation of the other end of the device.
Figure 5:
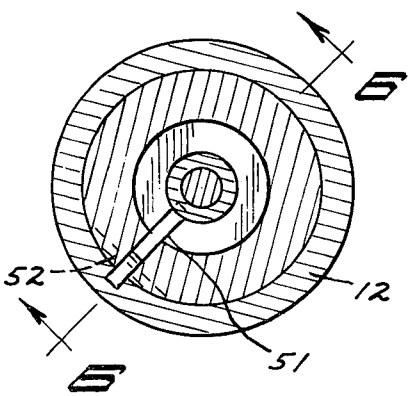
FIG. 5 is a view in vertical cross-section taken on line 5—5 of FIG. 2 as indicated.
Figure 2:
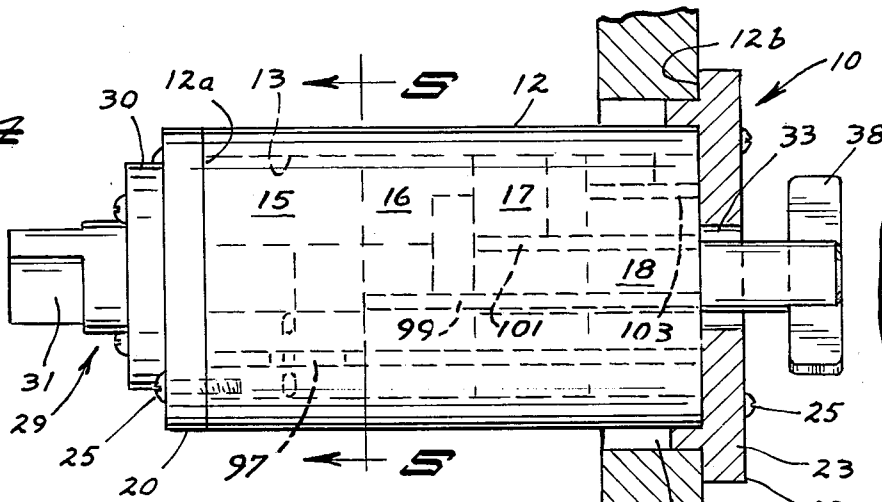
FIG. 2 is a view in side elevation with portions thereof being shown in vertical section.
Figure 4:
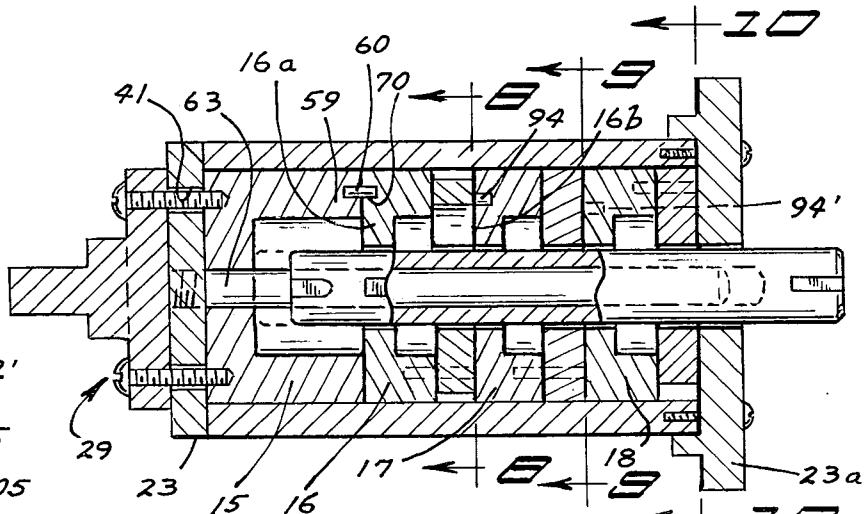
FIG. 4 is a view in vertical longitudinal section taken on line 4—4 of FIG. 1 as indicated with a portion thereof being broken away.
Figure 7:
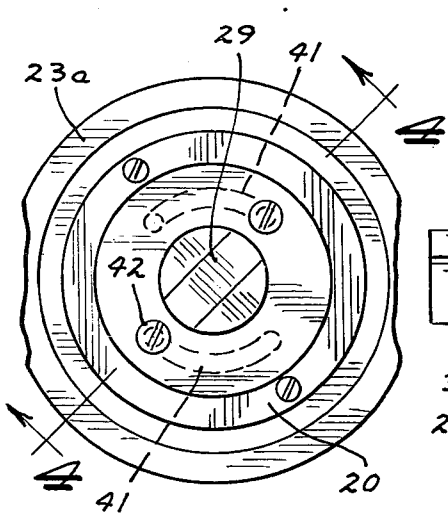
FIG. 7 is a view in vertical cross-section taken on line 7—7 of FIG. 6 as indicated.

Referring to the drawings, a lock structure 10 is shown which in the embodiment here presented is described as comprising a cylindrical tubular housing 12 having a bore 13 therethrough and having disposed therein a plurality of members 15–18 cylindrical in form and the same will be further described in detail. It will be understood that said members may vary as to number.

End plate or cap members 20 and 23 respectively enclose the ends **12*a* and 12*b* of said housing and the same are secured by screws 25. Said end member 23 has an extended annular flange portion 23*a*** to form a face plate to overlie an opening A as in a door structure.

Secured to the outer side of said cap member 20 is a latch or bolt operating plug member or plug 29 having a cylindrical base portion 30, the same having a latch engaging portion 31 non-circular in cross-section projecting therefrom.

Said end cap 23 has a key hole opening or key-way 33 centrally therethrough having a circular central portion 34 and a pair of diametrically opposed outwardly extended ears 35.

Disposable through said opening 33 and axially of said members 15–18 as will be described in detail is an operating member or key 38 which will be further described.

Referring now to the members 15–18, member 15 abuts the end cap member 20. Said end cap member 20 has a pair of opposed arcuate slots 41 therethrough and said plug member 29 is secured to said member 15 by screws 42, said screws extending through said slots whereby said plug member and said member 15 having unitary rotary movement to the extent of said slots.

Figure 6:
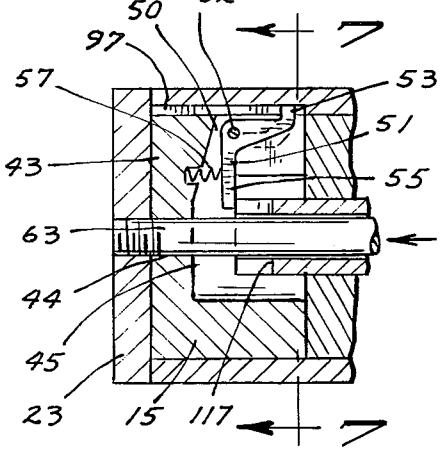
FIG. 6 is a broken view in vertical longitudinal section taken on line 6—6 of FIG. 5 as indicated.
Figure 10:
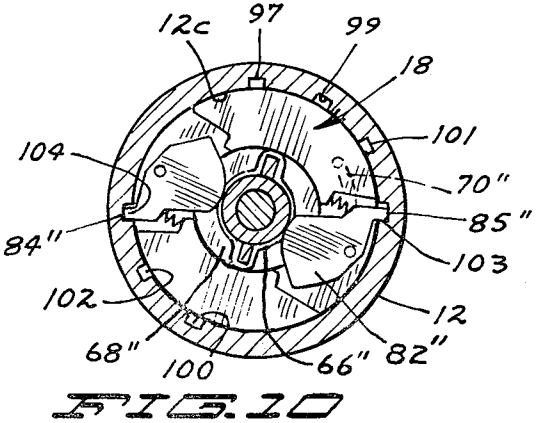
FIG. 10 is a view in vertical cross-section taken on line 10—10 of FIG. 4 as indicated.

Said member 15 has an end wall portion 43 with a cylindrical bore 44 extending therethrough and a counter-bore 45 through the remaining portion of said member 15 as indicated in FIG. 6.

A slot 50 longitudinally of said member 15 extends through a side wall portion thereof as shown in FIG. 6. A flat dog member 51 is disposed in said slot pivotally held therein by a pin 52 for vertical swinging movement longitudinally of said member 15. Said dog member has an ear 53 projecting thereabove and a depending leg portion 55 extending into said bore 45. A spring 57 is recessed into said end wall portion 43 as shown in FIG. 6 and bears against the adjacent portion of said leg and normally urges said ear 53 upwardly and outwardly of said slot 50 as will be further described. Projecting forwardly of the forward end wall portion 59 of said member 15 parallel to its axis is a pin 60.

A shaft of rod 63 is secured as by threading into said end cap member 20 centrally thereof as illustrated and said shaft extends axially through said member 15 and through said housing substantially to the plane of the other outer end of said housing.

The members 16–18 are alike in structure with one difference which will be described. Hence only member 16 will be described in detail and the corresponding parts of members 17–18 will bear corresponding reference numerals with a prime and a double prime respectively being added.

Figure 8:
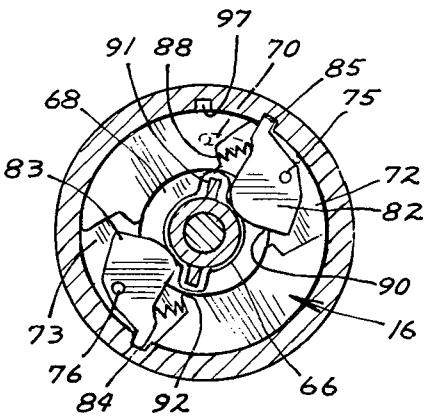
FIG. 8 is a view in vertical cross-section taken on line 8—8 of FIG. 4 as indicated.
Figure 7:
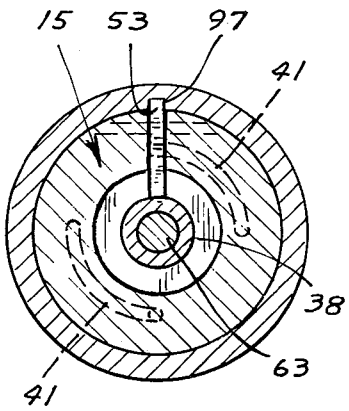

Said member 16 comprises a cylindrical plug having a bore 66 therein as indicated in FIG. 8 and having a counter-bore 68 extending throughout the remainder of said member. Said bore corresponds in transverse cross-section to the configuration of said key hole opening 33 and forms a key-way. An arcuate slot 70 is formed into the rear wall portion **16*a*** of said member.

Diametrically opposed open ended open top slots 72 and 73 are formed in the wall portions of said member 16 having said counter-bore therebetween as shown in FIG. 8. Pivot pins 75 and 76 respectively project outwardly from said slots in a direction longitudinal of said member 16. Respectively pivoted on said pins are tumblers 82 and 83 of a form as illustrated.

Said tumbler 82 has an outwardly projecting ear 85. Seated in a wall portion of said slot 72 and bearing against a portion of said tumbler underlying said ear 85 is a spring member 88 here shown as a coil spring. Said spring normally urges said ear upwardly of the outer surface of said member 16. Formed in the bottom wall 90 of said tumbler 82 is a cam or shoulder portion 91.

Said tumbler 83 is identical to said tumbler 82 as to structure and operation except for being in a reverse opposed position and it has an outwardly projecting ear 84 and an underlying shoulder portion 92. The slots 72 and 73 are of a configuration as illustrated to permit free swinging movement of said tumblers. It will be understood that said tumblers and their respective spring members may be otherwise formed.

Projecting forwardly of the front end wall portion **16*b* of said member 16 is a pin 94. A like pin 94' projects forwardly of the member 17. The member 18** has no forwardly projecting pin.

Said pin 60 extends into the arcuate slot 70, the pin 94 extends into the arcuate slot 70', and the pin 94' extends into the arcuate slot 70''. Said member 15–18 may be interengaged other than as here shown.

The arcuate slots 70,70' and 70'' permit each member 15–17 to have a limited relative rotational movement. With movement of said members 15–17 in a clockwise direction, said arcuate slots are positioned in staggered space relation in said clockwise direction whereby said members 15–17 will have progressive sequential rotational movement. As each member 15–17 reaches the end of the extend of its independent or relative movement, it then has unitary movement with the next adjacent member for a continuing progressive rotational movement until all of the members 15–18 rotate as a unit.

Formed on the inner wall portion **12*c* of said housing are a plurality of circumferentially staggered and longitudinally spaced longitudinal grooves 97, 99, 101 and 103. The members 15–18 are positioned within said housing 12 to have their respective pins 60, 94, and 94' and the corresponding arcuate slots 70, 70' and 70'' in a staggered clockwise circumferential or rotational relationship with the projecting ears 53, 85, 85' and 85'' being respectively aligned with and received into said grooves 97, 99, 101 and 103**.

Grooves 100, 102 and 104 are formed in diametrically opposed relation to said grooves 99, 101 and 103 to receive therein the projecting ears 84, 84' and 84''. Said ears of their respective tumblers must be withdrawn from their respective grooves for rotational movement of each of the members 15–18.

Figure 11:
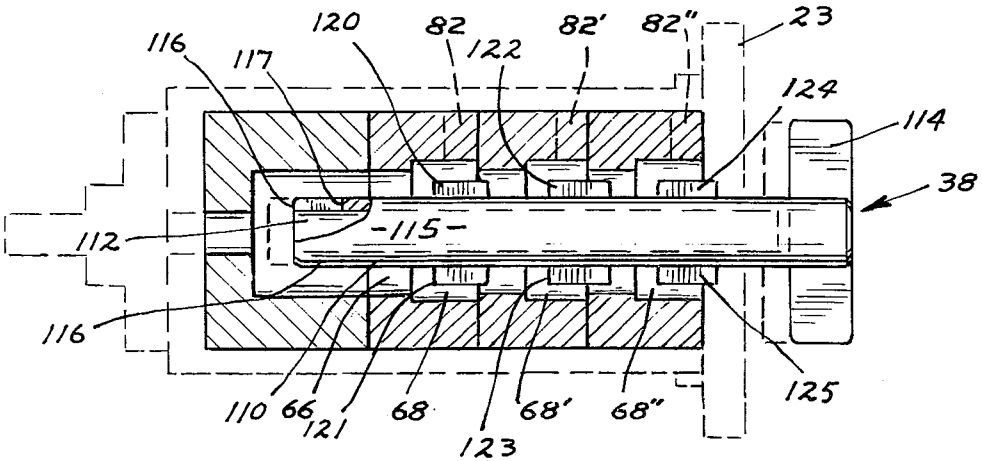
FIG. 11 is a view in longitudinal vertical section.
Figure 14:
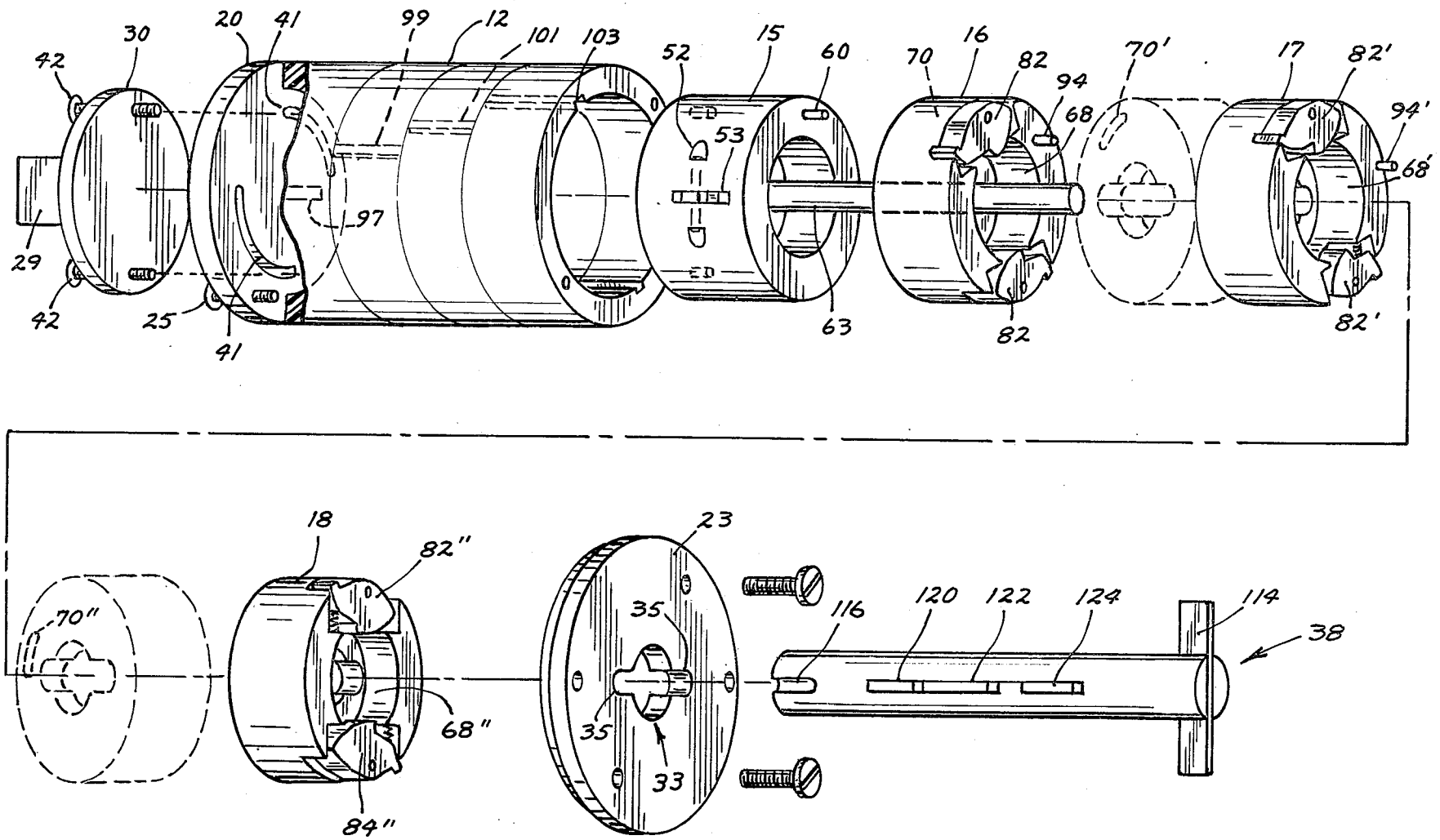

The key member 38 is here shown comprising a tubular shaft or barrel 110 circular in cross-section and having a bore 112 therein and a handle 114 secured to the outer end portion thereof as a cross member as illustrated in FIG. 11.

At the inner end portion 115 of said key member are a pair of opposed open top longitudinal grooves 116.

Upon insertion of the key member into the key opening 33 of the end cap member 23 and into the housing 12 through the respective bores of the members 15–18, the upper of said grooves 116 will receive therein said depending leg member 55 and the end wall 117 of said groove will engage and move said leg member against the pressure of said spring 57 and thus the ear 55 is withdrawn from the groove 97 to permit the member 15 to rotate with rotation of the key member in a clockwise direction to the extent of the movement of the pin 60 in the arcuate slot 70 of the member 16.

As above described herein the plug member 29 in being securd to the member 15 through the slots 25 has integral movement therewith.

Projecting from the shaft 110 of said key member 38 in the embodiment here presented are diametrically opposed pairs of lands spaced longitudinally of said shaft to respectively engage the respective opposed pairs of shoulders of the respective tumblers of said members 16–18. By way of example, the lands 120–121 engage the shoulders 91–92 of the tumblers 82 and 84 of the member 16.

Just as the member 15 has been rotated clockwise to the extent permitted by movement of the pin 60 in the slot 70, at this point, said lands 120 and 121 engage said shoulders 91 and 92 to swing the tumblers 82 and 83 in opposed directions for withdrawal of the ears 85 and 84 from the grooves 99 and 100. The member 15 is thus rotated together with the member 16 to the extent permitted by movement of the pin 94 in the slot 70'.

In like manner, the lands 122–123 engage the tumblers of the member 17 to withdraw said tumblers from their respective grooves for rotation of the member 17. Rotating with the member 17 will be the members 15 and 16 until all have rotated to the extent allowed for movement of the pin 94' in the arcuate slot 70''. At this point, the lands 124–125 engage the tumblers of the member 18 for withdrawal of the respective ears of said tumblers from their respective grooves for rotation of the member 18. Rotating with the member 18 will be the members 15–17 and all of said members then rotate as a unit to the extent of movement permitted the screws 42 in the slots 41. The slots 41 permit sufficient rotational movement for said plug member 29 to withdraw a latch member from a keeper (not here illustrated) to unlatch a locking mechanism.

Thus it is seen that the members 15–18 by means of the pins 60, 94 and 94' being disposed into the arcuate slots 70, 70' and 70'' are inter-connected and that there is a progressive sequential rotation of the members 15–18.

The lands of said key 38 must engage the respective tumblers of the members 15–18 for rotation of said members.

In connection with engaging the respective tumblers, each of the lands must be of no greater length than the length of its counter-bore chamber of the respective members 16–18 in order for the key to rotate. Any greater length of a land than the length of its respective counter-bore chamber, will result in a portion of the land extending into a bore of the same or of an adjacent cylindrical member or in the case of the cylindrical member 18, the land will not fully insert into the housing and the key member will not be able to rotate. The respective bores of the numbers 16–18 have the same configuration as the key hole 33 and do not permit the rotation of a land therein. Reference is had here to FIG. 11 wherein said lands are shown with relation to their respective counter-bores.

The lands must be of a precise height to suitably engage and swing their respective tumblers to withdraw the same from their lock positions.

It will be noted that the tumblers though here shown in opposed aligned relationship may be in various degrees of opposed offsetting relationship or there may be but one tumbler in each of the members 16–18 and the lengths of the bores and counter-bores will be designed and arranged accordingly. Thus there is an extremely large number of combinations possible for key variations. The tumblers may be otherwise designed as to configuration.

Figure 12:
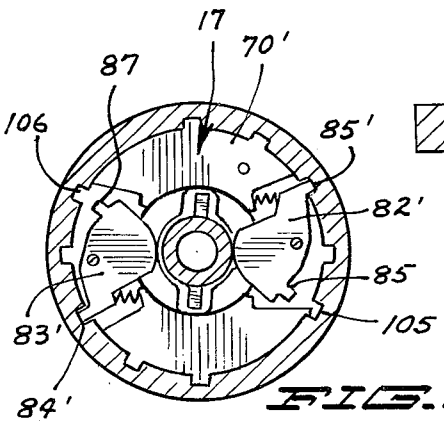
FIG. 12 is a view in vertical cross-section similar to the view in FIG. 9 showing a modification thereof.
Figure 9:
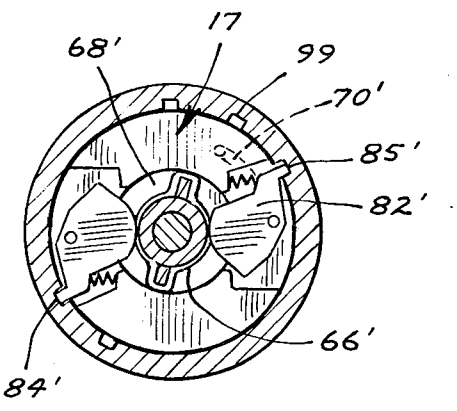
FIG. 9 is a view in vertical cross-section taken on line 9—9 of FIG. 4 as indicated.

A modification is shown in FIG. 12 in which is shown the structure of FIG. 9 with like reference numerals and the added structure is indicated by new reference numerals.

The tumblers 82' and 83' having additional projecting ears 86' and 87' respectively added thereto. Corresponding with said ears and positioned to receive the same therein are longitudinal grooves 105 and 106 formed in the adjacent side wall portion 17 of the housing 12. Like ears may be added to other of the tumblers above described or to all other of said tumblers and grooves adapted to receive the same will be formed within side wall 17 of said housing.

Thus with this modification, if a land does not precisely engage and operate or rotate its respective tumbler a precise distance, to withdraw the same from its respective groove, then the added ears of said tumbler will be moved such a distance as to be received within and locked in their respective grooves. For example, the ears 86' and 87' will be moved sufficiently to be received within the grooves 105 and 106 to lock the cylinder 17 against rotation. This structure makes it unusually difficult for any one to attempt to devise a key for the purpose of picking the lock.

From the above description it is seen that there has been provided a relatively simply made lock having inter-connected and inter-related parts which make it very difficult for a key to be made to pick the lock.

In the above description, the key member 38 has been described as rotating the cylindrical members 15–18 in a progressive sequence. It will be understood that said key member may have its lands arranged with a corresponding change in the initial staggered relative positions of the respective tumblers of said cylindrical members such that the cylindrical members are not rotated in a progressive sequence as described but in any desired order to ultimately rotate said cylindrical members as a unit to move the latch plug 29 to an unlock position.

Thus there are present an infinite number of variations for key arrangements.

It will of course be understood that various changes may be made in form, details, arrangement and proportions of the parts without departing from the scope of the invention herein which, generally stated, consists in an apparatus capable of carrying out the objects above set forth, in the parts and combinations of parts disclosed and defined in the appended claims.

What is claimed is:

1. A lock structure, having in combination a housing having a front and rear wall, a plurality of rotatable members in abutting relationship disposed in said housing, said front wall and said rotatable members defining a key-way there through, an arcuate slot through said rear wall, means disposed through said slot secured to the rotatable member adjacent said rear wall limiting the maximum rotation of movement of said rotatable member into an operating position, means inter-connecting said rotatable members permitting limited relative rotation of movement of each of said members and in a predetermined sequence causing said rotatable members to progressively move one another until all move unitarily, each of said rotatable members having one or more tumblers pivoted therein, said tumblers respectively holding said rotatable members in non-rotatable locked position, said rotatable members being rotationally positioned in a staggered relation relative to one another to have said tumblers misaligned in an operating direction relative to a common axis, each of said rotatable members having a bore and a counter bore, said tumblers being pivotally carried by each of said rotatable members and being mounted therein to project into the counter bore thereof, said counter bores each having a predetermined length, said tumblers respectively having a cam surface extending into said counter bore and having a portion thereof lockingly engaged in said housing, each of the bores of said rotatable members having a predetermined length, a key disposed in said key-way, said key having aligned projecting lands, said key-way defining a slot in said bores, each of said slots having a length equal to the diameter of the counter bore adjacent thereto, said lands on said key being spaced apart the length of the respective bores of said rotatable members, and said key being positioned within said key-way to have each land thereof within a respective counter bore and the height of each land being such as to respectively engage the adjacent cam surface of its respective tumbler in said counter bores to pivot and release said tumbler from locking engagement with said housing for the respective rotation of said rotatable members by rotative movement of said key.

2. The structure set forth in claim 1, wherein each of said rotatable members has an arcuate slot in one end wall portion thereof, each of said rotatable members save one has a pin therein projecting from an end wall thereof, said pins respectively being received in a corresponding of said arcuate slots formed in the abutting wall of an adjacent rotatable member, and said rotatable members in said locked position are positioned relative to each other such as to have their respective pairs of pins and corresponding slots spaced in a circumferentially staggered relation.

3. The structure set forth in claim 1, wherein said rotatable members and their respective tumblers in said locked position are circumferentially positioned in a staggered relation relative to each other, each of said tumblers has a projecting portion, said housing has a plurality of grooves in an inner wall portion thereof in such staggered relation as to receive the respective projecting portions of said tumblers, and said operating member in rotating engages said tumblers of said respective rotatable members in a given order to withdraw the projecting portion of each of said tumblers from its respective groove in said housing.

4. The structure set forth in claim 1, wherein one of said rotatable members has a tumbler therein movable about an axis at right angles to the axis of said housing, and the remaining of said rotatable members each has its respective tumbler moveable about an axis parallel with the axis of said housing.

5. The structure set forth in claim 3, wherein at least one of said tumblers has a second projecting portion spaced from said first mentioned projecting portion thereof, and said housing has means to releasingly secure said second projecting portion of said tumbler.

6. The structure set forth in claim 5, wherein said means comprises a groove.

7. The structure set forth in claim 5, wherein said operating member has a projection thereon engaging said projecting portion of said one of said tumblers, and said projection being of such precise height as to move said one of said tumblers to have said first mentioned projecting portion of said tumbler withdrawn from its corresonding groove and to move said second projecting portion of said one of said tumblers a distance short of being disposed within its corresponding groove.

* * * * *